US011441772B2

(12) United States Patent
Black et al.

(10) Patent No.: US 11,441,772 B2
(45) Date of Patent: Sep. 13, 2022

(54) FORCED-DRAFT PRE-MIX BURNER DEVICE

(71) Applicant: Brunswick Corporation, Mettawa, IL (US)

(72) Inventors: Stuart C. Black, Ballyclare (IE); Philip Eadie, Bangor (IE); Michael J. Biel, Beaver Dam, WI (US)

(73) Assignee: Brunswick Corporation, Mettawa, IL (US)

( * ) Notice: Subject to any disclaimer, the term of this patent is extended or adjusted under 35 U.S.C. 154(b) by 330 days.

(21) Appl. No.: 16/039,399

(22) Filed: Jul. 19, 2018

(65) Prior Publication Data

US 2020/0025368 A1 Jan. 23, 2020

(51) Int. Cl.

| | |
|---|---|
| ***F23D 14/02*** | (2006.01) |
| ***F23D 14/36*** | (2006.01) |
| ***F23D 14/66*** | (2006.01) |
| ***F23L 5/02*** | (2006.01) |
| ***F23L 15/04*** | (2006.01) |

(52) U.S. Cl.

CPC ..... *F23D 14/02* (2013.01); *F23D 14/36* (2013.01); *F23D 14/66* (2013.01); *F23L 5/02* (2013.01); *F23L 15/04* (2013.01)

(58) Field of Classification Search

CPC ..... F23D 14/62

USPC ..... 431/166

See application file for complete search history.

(56) References Cited

U.S. PATENT DOCUMENTS

| | | | | |
|---|---|---|---|---|
| 4,086,048 | A | 4/1978 | Carlson | |
| 4,474,534 | A * | 10/1984 | Thode | F04D 29/328 415/119 |
| 4,712,996 | A | 12/1987 | Adams et al. | |
| 5,062,790 | A | 11/1991 | Loberger et al. | |
| 5,232,153 | A * | 8/1993 | Mohring | F24H 9/0068 126/110 B |
| 5,335,841 | A | 8/1994 | Yamanashi | |
| 5,355,841 | A | 10/1994 | Moore, Jr. et al. | |
| 5,682,826 | A | 11/1997 | Hollenbeck | |
| 5,865,616 | A | 2/1999 | George | |
| 5,924,859 | A | 7/1999 | Nolte | |

(Continued)

FOREIGN PATENT DOCUMENTS

| | | |
|---|---|---|
| DE | 3144787 | 8/1983 |
| DE | 3604314 | 8/1987 |

(Continued)

OTHER PUBLICATIONS

Office Action issued for European Patent Application No. 19181303.9, dated Nov. 21, 2019.

(Continued)

*Primary Examiner* — Steven B McAllister
*Assistant Examiner* — John E Bargero
(74) *Attorney, Agent, or Firm* — Andrus Intellectual Property Law, LLP

(57) ABSTRACT

A forced-draft pre-mix burner device has a housing that conveys air from an upstream cool air inlet to a downstream warm air outlet. A heat exchanger warms the air prior to discharge via the warm air outlet. A gas burner burns an air-gas mixture to thereby warm the heat exchanger. A fan mixes the air-gas mixture and forces the air-gas mixture into the gas burner. The fan has a plurality of blades having sinusoidal-modulated blade spacing.

20 Claims, 9 Drawing Sheets

(56) References Cited

U.S. PATENT DOCUMENTS

| | | | | |
|---|---|---|---|---|
| 5,931,660 | A | 8/1999 | Amrhein et al. | |
| 5,984,664 | A | 11/1999 | Sutton | |
| 7,131,462 | B1 | 11/2006 | Chen | |
| 7,223,094 | B2 | 5/2007 | Goebel | |
| 3,075,304 | A1 | 12/2011 | Cox et al. | |
| 9,046,108 | B2 | 6/2015 | Duke et al. | |
| 10,718,518 | B2 | 7/2020 | Eadie et al. | |
| 2002/0086254 | A1 | 7/2002 | Chen | |
| 2006/0051718 | A1 | 3/2006 | Kamal et al. | |
| 2006/0199123 | A1 | 9/2006 | Seguin et al. | |
| 2009/0211540 | A1 | 8/2009 | Yin et al. | |
| 2010/0112500 | A1 | 5/2010 | Maiello et al. | |
| 2011/0052385 | A1* | 3/2011 | Duke | F04D 29/666 415/203 |
| 2014/0209086 | A1 | 7/2014 | Potter | |
| 2015/0081086 | A1 | 3/2015 | Hallowell et al. | |
| 2015/0276221 | A1 | 10/2015 | Abate et al. | |
| 2016/0047547 | A1 | 2/2016 | Barels | |
| 2017/0030581 | A1 | 2/2017 | Li et al. | |
| 2020/0025368 | A1 | 1/2020 | Black et al. | |
| 2020/0232643 | A1 | 7/2020 | Henrich | |
| 2020/0309137 | A1* | 10/2020 | Kuriger | F04D 29/441 |

FOREIGN PATENT DOCUMENTS

| | | |
|---|---|---|
| DE | 10220774 | 11/2003 |
| EP | 2278224 | 1/2011 |
| EP | 2667097 | 11/2013 |
| EP | 2871415 | 5/2015 |
| EP | 3124866 | 2/2017 |
| WO | 2010/094673 | 8/2010 |
| WO | 2017085680 | 5/2017 |

OTHER PUBLICATIONS

Extended European Search Report for European Patent Application No. 19181303.9, dated Feb. 20, 2020.

Donald Ewald et al., Noise Reduction by Applying Modulation Principles, The University of Wisconsin, Department of Mechanical Engineering, Madison, Wisconin 53705, The Journal of the Acoustical Society of America, Received Nov. 23, 1970, pp. 1381-1385.

Partial European Search Report, EP Patent Application No. 20189202.3, dated Sep. 18, 2020.

Extended European Search Report, EP Patent Application No. 20189202.3, dated Nov. 13, 2020.

Extended European Search Report, EP Patent Application No. 21162729.4, dated Jun. 25, 2021.

European Search Report, EP Patent Application No. 21204492.9, dated Apr. 13, 2022.

* cited by examiner

| Blade Number, *i* | Evenly Spaced Blade Angle, $\theta_i$ (deg) | Modulated Blade Angle, $\theta_i'$ (deg) | Blade Angle Delta $\Delta\theta sin(m\theta_i)$ (deg) |
|---|---|---|---|
| 1 | 15.7 | 19.0 | 3.4 |
| 2 | 31.3 | 35.9 | 4.6 |
| 3 | 47.0 | 49.9 | 2.9 |
| 4 | 62.6 | 62.0 | -0.6 |
| 5 | 78.3 | 74.5 | -3.8 |
| 6 | 93.9 | 89.4 | -4.5 |
| 7 | 109.6 | 107.2 | -2.4 |
| 8 | 125.2 | 126.5 | 1.2 |
| 9 | 140.9 | 145.0 | 4.1 |
| 10 | 156.5 | 160.9 | 4.3 |
| 11 | 172.2 | 174.0 | 1.8 |
| 12 | 187.8 | 186.0 | -1.8 |
| 13 | 203.5 | 199.1 | -4.3 |
| 14 | 219.1 | 215.0 | -4.1 |
| 15 | 234.8 | 233.5 | -1.2 |
| 16 | 250.4 | 252.8 | 2.4 |
| 17 | 266.1 | 270.6 | 4.5 |
| 18 | 281.7 | 285.5 | 3.8 |
| 19 | 297.4 | 298.0 | 0.6 |
| 20 | 313.0 | 310.1 | -2.9 |
| 21 | 328.7 | 324.1 | -4.6 |
| 22 | 344.3 | 341.0 | -3.4 |
| 23 | 360.0 | 360.0 | 0.0 |

*FIG. 10*

FORCED-DRAFT PRE-MIX BURNER DEVICE

FIELD

The present disclosure relates to forced-draft pre-mix burner devices, for example in space heaters.

BACKGROUND

The following U.S. Patents are incorporated herein by reference:

U.S. Pat. No. 5,931,660 discloses a gas premix burner in which gas and air are mixed in a suction region of an impeller to form a combustion mixture. The impeller is associated with a blower housing and an electronic control circuit board, all of which are arranged upstream in a blower chamber having at least one flame separating wall. The arrangement prevents the gas and the combustion mixture from reaching the motor landings or the printed circuit board.

U.S. Pat. No. 7,223,094 discloses a blower for combustion air in a wall/floor furnace that includes a blower housing, and blower wheel, with an air inlet and an air outlet, and with a fuel feeder line for fuel, wherein a mass current sensor for determining the air mass current is located on the air inlet, which is functionally connected with a data processing device and sends signals to the data processing device for calculation of a ratio of combustion medium to combustion air in dependence on a desired heating capacity.

U.S. Pat. No. 9,046,108 discloses a centrifugal blower in a cooling system of an electronic device having asymmetrical blade spacing. The asymmetrical blade spacing is determined according to a set of desired acoustic artifacts that are favorable and balance that is similar to that found with equal fan blade spacing. In one embodiment, the fan impeller can include thirty one fan blades.

SUMMARY

This Summary is provided to introduce a selection of concepts that are further described below in the Detailed Description. This Summary is not intended to identify key or essential features of the claimed subject matter, nor is it intended to be used as an aid in limiting the scope of the claimed subject matter.

A forced-draft pre-mix burner device has a housing that conveys air from an upstream cool air inlet to a downstream warm air outlet. A heat exchanger warms the air prior to discharge via the warm air outlet. A gas burner burns an air-gas mixture to thereby warm the heat exchanger. A fan mixes the air-gas mixture and forces the air-gas mixture into the gas burner. The fan has a plurality of blades with sinusoidal-modulated blade spacing. The fan further has an end cap having an end wall that faces the plurality of blades, an air-gas mixture inlet through which the air-gas mixture is conveyed to the plurality of blades, and an air-gas mixture outlet through which the air-gas mixture is conveyed to the gas burner. The air-gas mixture inlet is connected to the air-gas mixture outlet via a channel formed in the end wall.

BRIEF DESCRIPTION OF THE DRAWINGS

The present disclosure is described with reference to the following Figures. The same numbers are used throughout the Figures to reference like features and like components.

Unless otherwise specifically noted, articles depicted in the drawings are not necessarily drawn to scale.

FIG. 10 is a table listing physical characteristics of the fan.

DETAILED DESCRIPTION OF THE DRAWINGS

Figure 1:
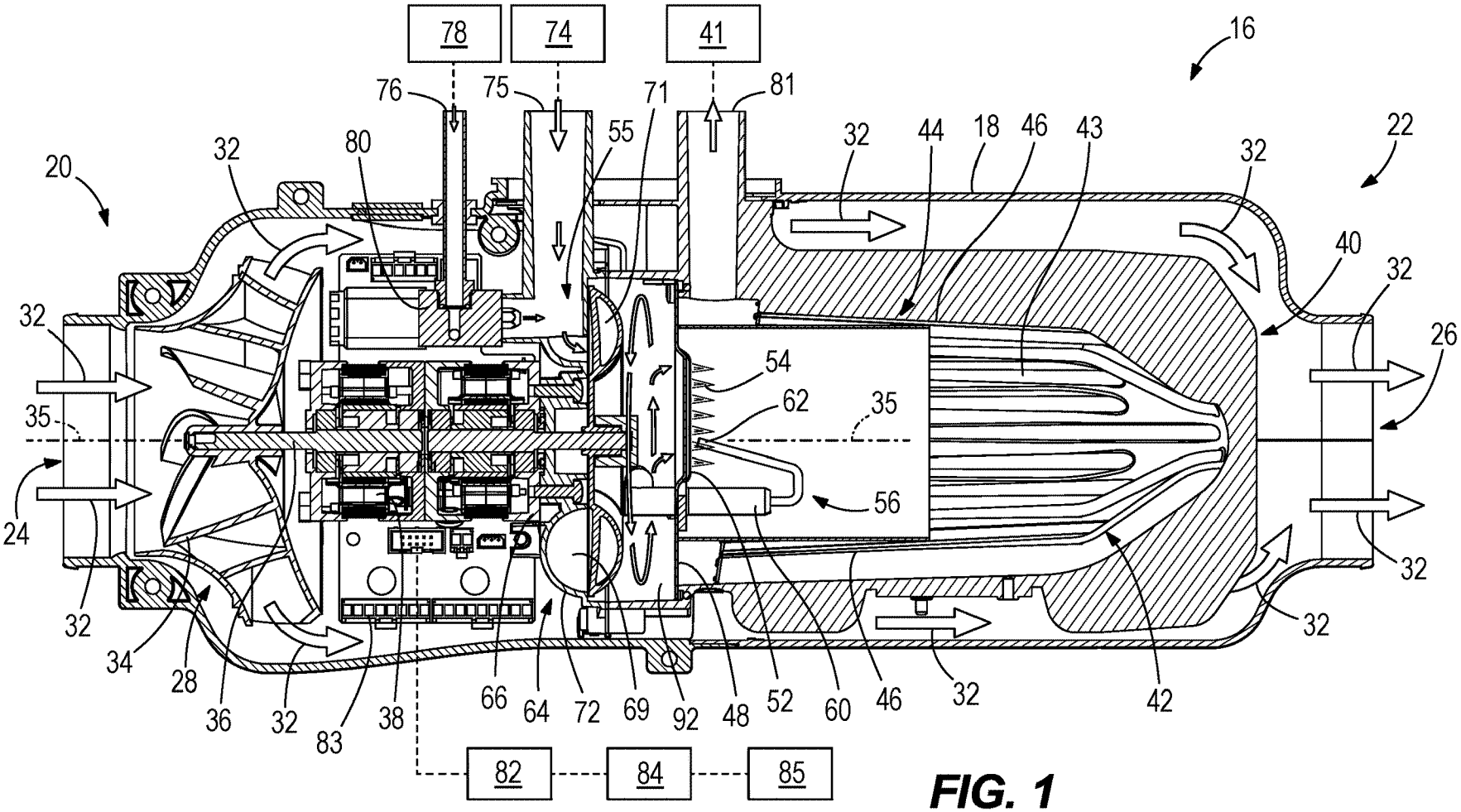
FIG. 1 is a sectional view of a gas burner device according to the present disclosure, which in this example is a space heater.

It should be understood at the outset that, although exemplary embodiments are illustrated in the figures and described below, the principles of the present disclosure may be implemented using any number of techniques, whether currently known or not. The present disclosure should in no way be limited to the exemplary implementations and techniques illustrated in the drawings and described below.

The present disclosure relates to forced-draft premix gas burners in which air and a combustible gas, such as liquid propane, are fully mixed by a fan and then delivered to a burner. These devices are often utilized in space heaters. Through research and experimentation, the present inventors found that increasing the number of blades on the fan increases the number of chambers in which to mix the gases, thereby improving mixing results. Increasing the number of blades also enables use of open/closed gas valves, such as for example solenoids, eliminating the need for a venturi or similar structure. However, the present inventors also found that increasing the number of blades creates unwanted noise. More specifically, a pressure pulse is created when the blade moves past a stator. Increasing the number of blades increases the number of pressure pulses, thus increasing blade pass frequency which produces an unpleasant sound quality. The periodicity of evenly spaced blade pass events creates tone prominence, which the inventors found can be loud and potentially annoying.

The present disclosure results from the inventors' efforts to optimize radial mixing of the air and gas, while minimizing fan noise.

Figure 2:
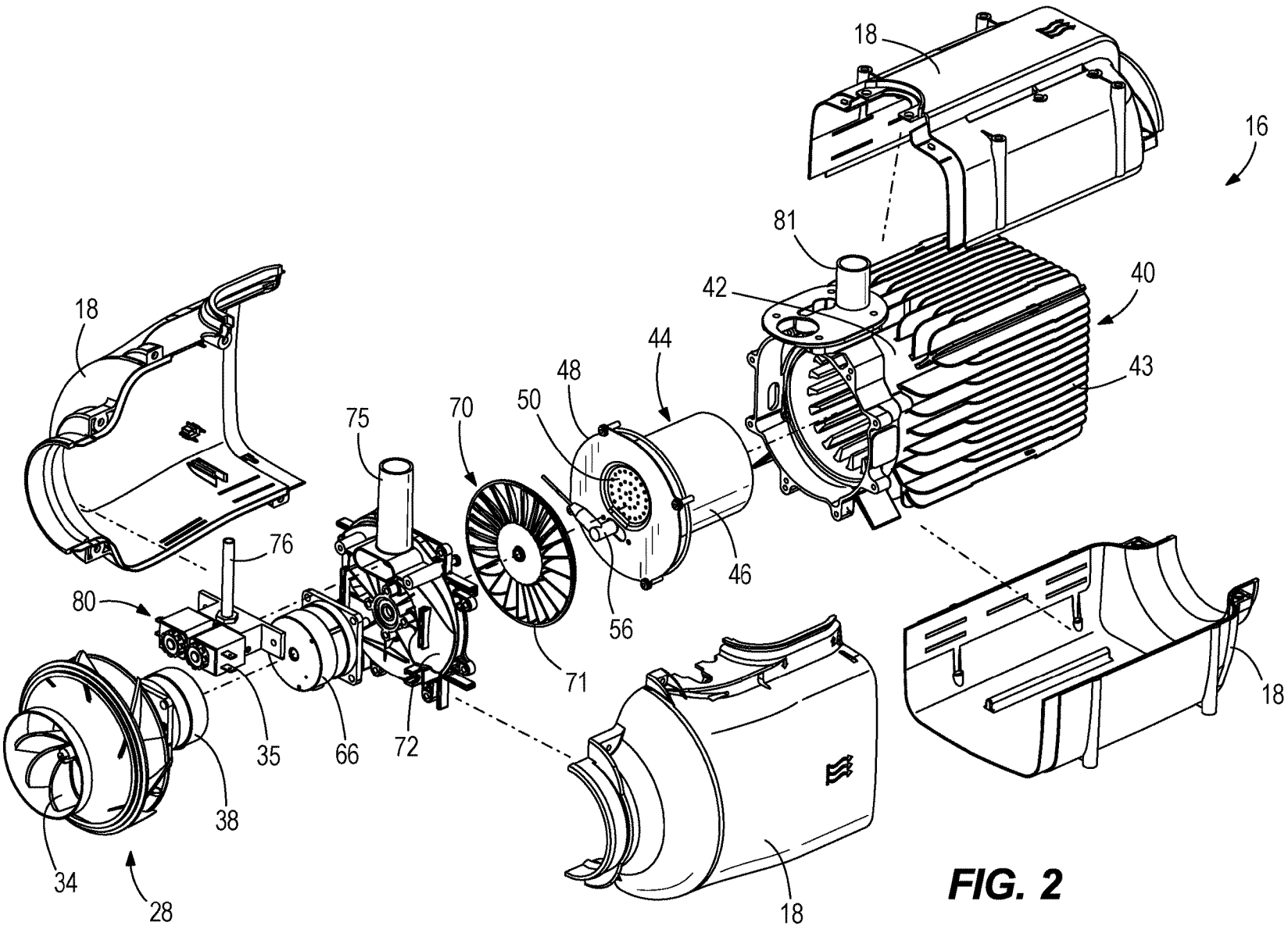
FIG. 2 is an exploded view of the gas burner device.
Figure 3:
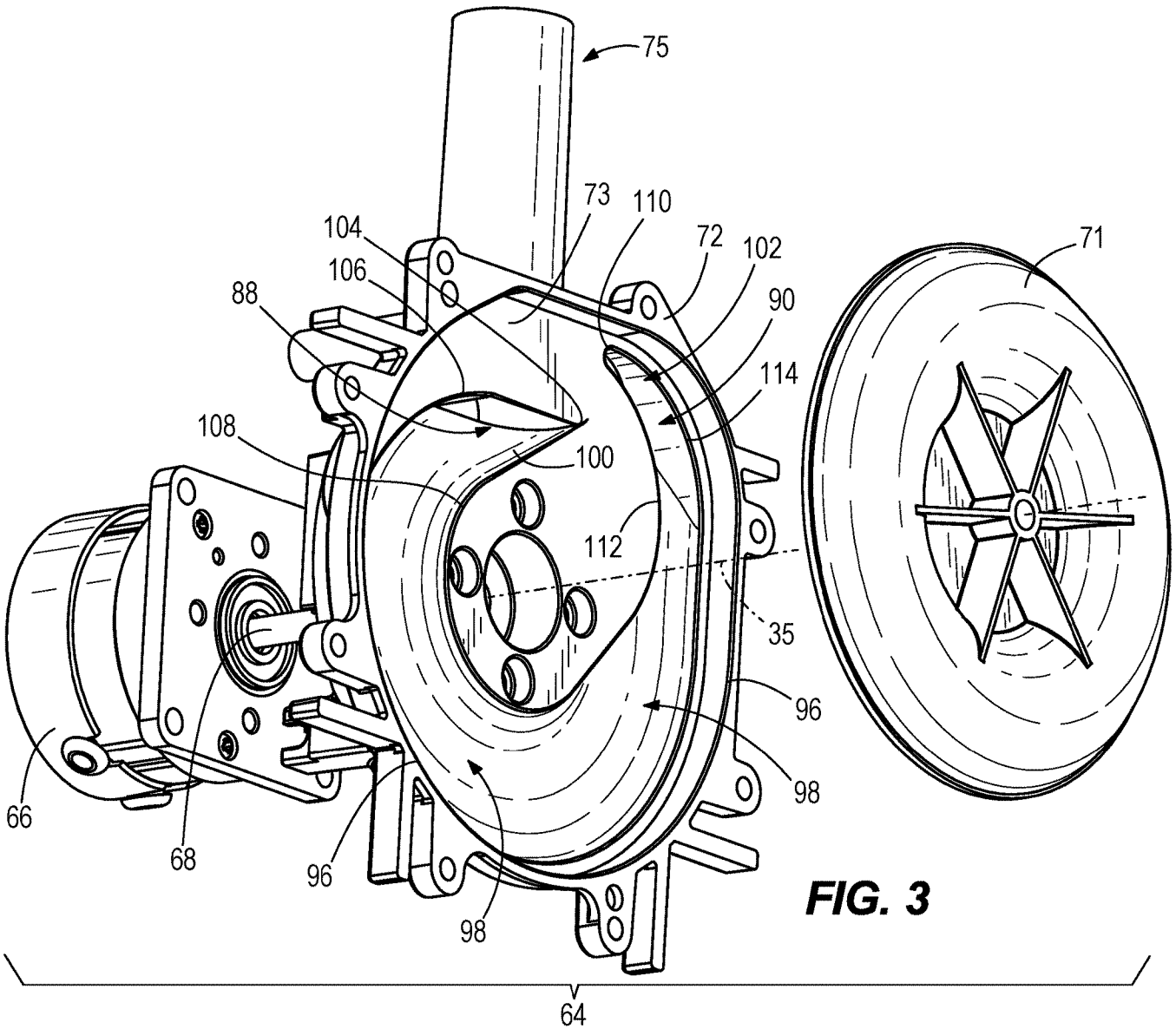
FIG. 3 is an exploded view of a motor, fan, and end cap for mixing and conveying an air-gas mixture to the gas burner.
Figure 5:
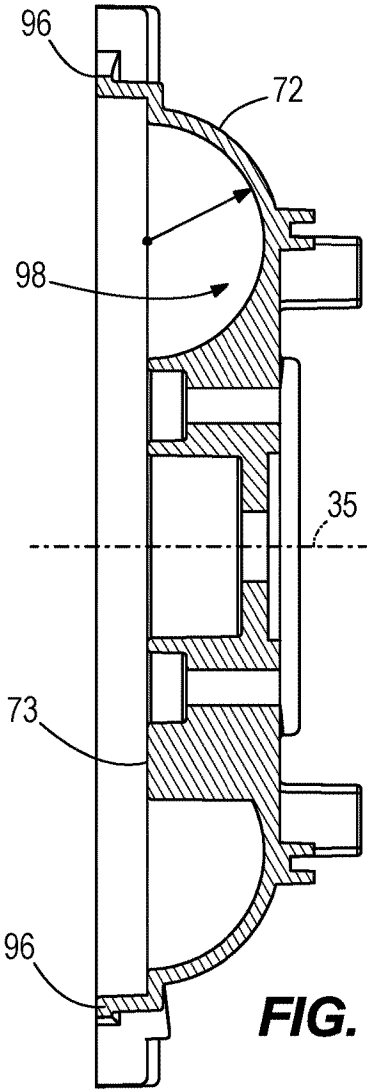
FIG. 5 is a view of section 5-5, taken in FIG. 4.
Figure 4:
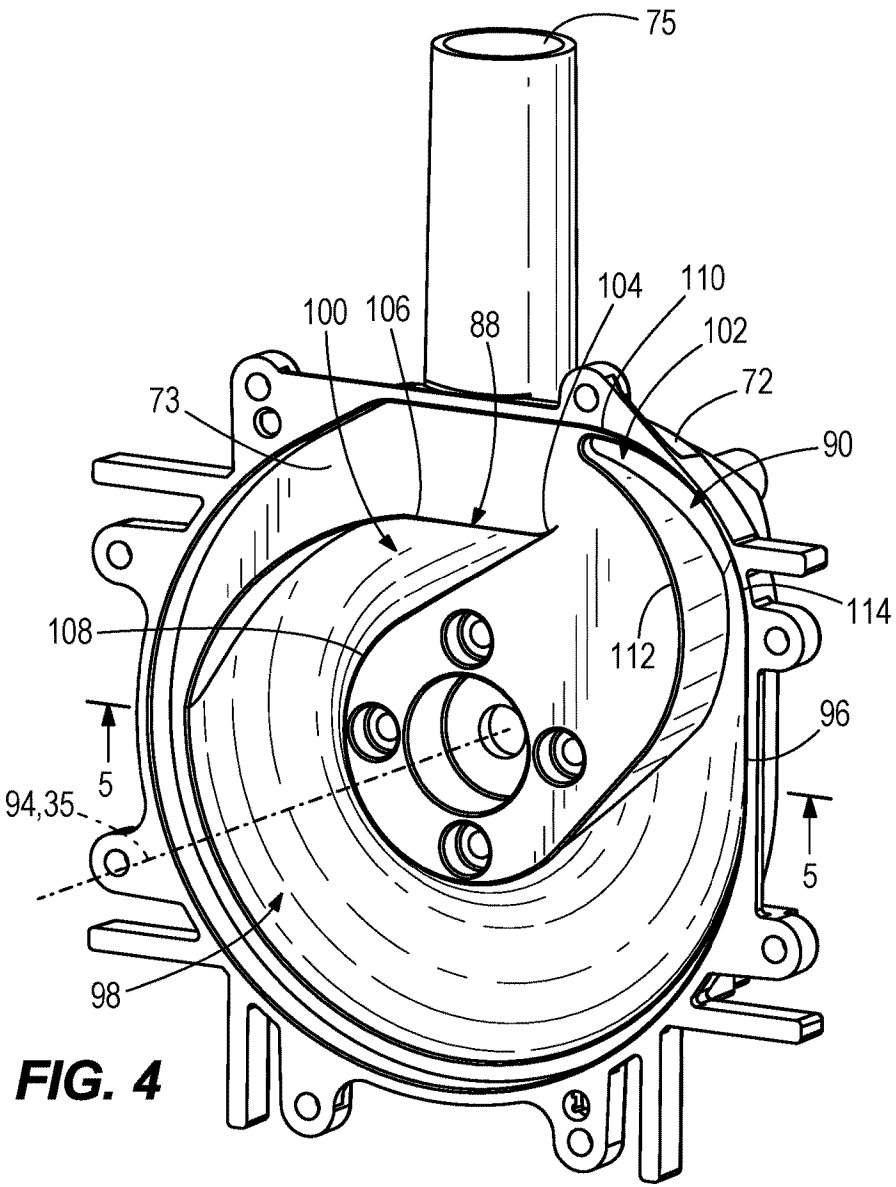
FIG. 4 is a front perspective view of the inside surface of the end cap, showing an air-gas mixture inlet through which the air-gas mixture is conveyed to the fan and an air-gas mixture outlet through which the air-gas mixture is conveyed to the gas burner.

FIGS. 1 and 2 depict a forced-draft premix burner device 16 according to the present disclosure. The premix burner device 16 has an elongated plastic housing 18 that extends from an upstream side 20 (left side in FIG. 1) to downstream side 22 (right side in FIG. 1). The housing 18 has an upstream cool air inlet 24 located at the upstream side 20 and a downstream warm air outlet 26 located at the downstream side 22. A fan 28 located in the housing 18 draws air from the surrounding atmosphere into the cool air inlet 24 and forces the air through the housing 18 to the warm air outlet 26, as shown by arrows 32. The fan 28 has a plurality of fan blades 34 that rotates about an axis of rotation 35 defined by an output shaft 36 of an electric motor 38. Operation of the electric motor 38 causes rotation of the output shaft 36, which in turn causes rotation of the fan blades 34. Rotation of the fan blades 34 forces air from upstream to downstream through the housing 18. The configuration of the fan 28, including the fan blades 34 and electric motor 38, are conventional and can vary from what is shown in the drawings. The gas burner device 16 further has a heat exchanger 40 that warms the air prior to discharge via the warm air outlet 26. The heat exchanger 40 has a cast aluminum body 42 with a plurality of heat radiating fins 43.

The gas burner device 16 also has a gas burner 44 that extends into the body 42 and heats the heat exchanger 40. The gas burner 44 has an elongated metal flame tube 46 into which a fully pre-mixed air-gas mixture is conveyed for combustion. The manner in which the air-gas mixture is mixed and conveyed to the gas burner 44 is a principle subject of the present disclosure and is further described herein below with reference to FIGS. 3-11. A metal burner deck 48 is disposed on the upstream end of the flame tube 46. The burner deck 48 has a plurality of aeration holes 50 through which the air-gas mixture is caused to flow, as will be further explained herein below. In the illustrated example, the aeration holes 50 includes a total of thirty-three aeration holes, each having a diameter of between 2.9 and 3.1 millimeters. Together, the aeration holes 50 provide an open area of between 15.3%-17.4% of the portion of the burner deck 48 inside the flame tube 46. No secondary air is introduced into the gas burner 10. A metal burner skin 52 is located in the flame tube 46 and is attached to the inside surface of the burner deck 48 so that the burner skin 52 covers the aeration holes 50. In the illustrated example, the burner skin 52 is made of woven metal matting; however the type and configuration of the burner skin 52 can vary from what is shown. As shown in FIG. 1, the burner skin 52 is configured to distribute the air-gas mixture from the aeration holes 50 and thus facilitate a consistent and evenly distributed burner flame 54 inside the flame tube 46.

An ignition and flame sensing electrode 56 is disposed in the flame tube 46, proximate to the burner skin 52. The electrode 56 extends through a through-bore in the burner deck 48 and is coupled to the burner deck 48. The type of electrode 56 and the manner in which the electrode 56 is coupled to the gas burner 44 can vary from what is shown. The electrode 56 can be a conventional item, for example a Rauschert Electrode, Part No. P-17-0044-05. The electrode 56 has a ceramic body 60 and an electrode tip 62 that is oriented towards the burner skin 52. The electrode 56 is configured to ignite the air-gas mixture as the air-gas mixture passes through the flame tube 46 via the aeration holes 50. The resulting burner flame 54 is thereafter maintained as the noted air-gas mixture flows through the burner skin 52.

In some non-limiting examples, the electrode 56 can be configured to measure the flame ionization current associated with the burner flame 54. Specifically, the electrode tip is placed at the location of the burner flame 54 with a distance of 2.5+/−0.5 mm between the electrode tip and the burner skin 52. A voltage of 275+/−15V is applied across the electrode 56 and burner skin 52, with the electrode 56 being positive and the burner skin 52 being negative. The chemical reactions that occur during combustion create charged particles, which are proportional to the air/fuel ratio of a given fuel. The potential difference across the gas burner 44 can be used to measure and quantify this. The electrode 56 is configured to measure the differential and, based on the differential, determine the flame ionization current, as is conventional and known in the art. The flame ionization current is inversely proportional to the "equivalence ratio", namely the ratio of actual air-to-fuel ratio to stoichiometry for a given mixture. Lambda is 1.0 at stoichiometry, greater than 1.0 in rich mixtures, and less than 1.0 at lean mixtures. Thus a decrease in flame ionization current correlates to an increase in the equivalence ratio, and vice versa.

Referring now to FIGS. 3-9, the gas burner device 16 also has a variable-speed combustion fan 64 that fully pre-mixes the above-noted air-gas mixture and forces the air-gas mixture into the gas burner 44 for combustion. In the illustrated example, a brushless DC electric motor 66 is located adjacent to the electric motor 38 for the fan 28. The electric motor 66 has an output shaft 68 that is coaxial with the axis of rotation 35 of the output shaft 36 of the fan 28 (see FIG. 1). The fan 64 has a plurality of blades 70 spaced apart around a fan hub cap 71, which is coupled to the output shaft 68. The construction and spacing of the blades 70 are further described herein below. Operation of the electric motor 66 causes rotation of the output shaft 68 about the axis of rotation 35, which in turn causes commensurate rotation of the hub cap 71 and associated blades 70. The electric motor 66 is mounted to an end cap 72 having an end wall 73 that faces the fan hub cap 71 and associated blades 70. The output shaft 68 extends through the center of the end cap 72. The fan hub cap 71 and associated blades 70 rotate about the axis of rotation 35 defined by the output shaft 68 of the electric motor 66, while the end cap 72 remains stationary. Together, the fan hub cap 71 and end wall 73 define an interior 69 (see FIG. 1) of the fan 64.

Referring to FIG. 1, a combustion air inlet 75 extends into the housing 18 and conveys air from a source of combustion air 74 to the interior 69 of the fan 28. The source of combustion air 74 can be atmosphere or any other source of suitable air for combustion. Rotation of the blades 70 draws the air into the combustion air inlet 75. A combustion gas inlet 76 conveys combustion gas from a source of combustion gas 78, for example liquid propane gas (LPG). One or more control valves 80 control the flow of combustion gas into the fan 64. The type and configuration of the control valves 80 can vary from what is shown. In the illustrated example, the control valves 80 are conventional open/closed solenoid valves that discharge combustion gas in parallel to the fan 64. Each solenoid valve is configured to fully open and fully close to thereby control the flow of gas to the fan 64. In a non-limiting example, the control valves 80 facilitate four discrete power settings. The power settings include "off" wherein both of the solenoid coils are fully closed, "low" wherein one of the solenoid coils is fully open and the other solenoid coil is fully closed, "medium" wherein the one solenoid coil is fully closed and the other solenoid coil is fully open, and "high" wherein both of the solenoid coils are fully open. The electric motor 66 has corresponding discrete power settings, each power setting having a minimum fan speed.

| Power Setting | Gross Heat Input (kW) | Min Fan Speed (rpm) |
|---|---|---|
| Off | 0 | 0 |
| Low | 1.35 | 1500 |
| Medium | 4.7 | 3600 |
| High | 6 | 4800 |

It will thus be understood by those having ordinary skill in the art that the gas burner device 16 is a "fully premix" gas burner device in which all the gas (e.g. LPG) is introduced via the control valves 80 and all air introduced into the flame tube 46 is mixed via the fan 64. The air and gas are mixed together to form the air-gas mixture, which is ignited by the electrode 56 to produce the burner flame 54. In the illustrated example, the air and gas initially are brought together in an upstream gallery 55 (see FIG. 1) located immediately upstream of the end cap 72 and then, as more fully described herein below, are drawn into the interior 69 of the fan 64 and more thoroughly mixed by the blades 70. A spent combustion gas outlet 81 extends out of the body 42 of the heat exchanger 40 and out of the housing 18. The spent combustion gas outlet 81 conveys spent combustion gas from the flame tube 46 for treatment via a conventional treatment device 41 and/or other disposal after it has been ignited and burned in the gas burner 44.

In certain non-limiting examples, the gas burner device 16 includes a computer controller 82, shown in FIG. 1. Optionally, the controller 82 can be embodied in a printed circuit board 83 contained in the housing 18. The controller 82 can be programmed to actively control the speed of the fan 64 based on the flame ionization current measured by the electrode 56. The controller 82 includes a computer processor, computer software, a memory (i.e. computer storage), and one or more conventional computer input/output (interface) devices. The processor loads and executes the software from the memory. Executing the software controls operation of the gas burner device 16. The processor can include a microprocessor and/or other circuitry that receives and executes software from memory. The processor can be implemented within a single device, but it can alternately be distributed across multiple processing devices and/or subsystems that cooperate in executing program instructions. Examples include general purpose central processing units, application specific processors, and logic devices, as well as any other processing device, combinations of processing devices, and/or variations thereof. The controller 82 can be located anywhere with respect to the gas burner device 16 and can communicate with various components of the gas burner device 16 via the wired and/or wireless links shown schematically in the drawings. The memory can include any storage media that is readable by the processor and capable of storing the software. The memory can include volatile and/or nonvolatile, removable and/or non-removable media implemented in any method or technology for storage of information, such as computer readable instructions, data structures, program modules, or other data. The memory can be implemented as a single storage device but may also be implemented across multiple storage devices or subsystems. The computer input/output device can include any one of a variety of conventional computer input/output interfaces for receiving electrical signals for input to the processor and for sending electrical signals from the processor to various components of the gas burner device 16. The controller 82, via the noted input/output device, communicates with the electrode 56, fan 64, and control valves 80 to control operation of the gas burner device 16. The controller 82 is capable of monitoring and controlling operational characteristics of the gas burner device 16 by sending and/or receiving control signals via one or more of the links. Although the links are each shown as a single link, the term "link" can encompass one or a plurality of links that are each connected to one or more of the components of the gas burner device 16. As mentioned herein above, these can be wired or wireless links.

The gas burner device 16 can further include an operator input device 84 for inputting operator commands to the controller 82. The operator input device 84 can include a power setting selector, which can include for example a push button, switch, touch screen, or other device for inputting an instruction signal to the controller 82 from the operator. Such operator input devices for inputting operator commands to a controller are well known in the art and therefore for brevity are not further herein described. The gas burner device 16 can further include one or more operator indicator devices 85, which can include a visual display screen, a light, an audio speaker, or any other device for providing feedback to the operator.

In use, the controller 82 is configured to receive an input (e.g. a power setting selection) from an operator via the operator input device 84. In response to the input, the controller 82 is further configured to send a control signal to the fan 64 to thereby modify (turn on or increase) the speed of the electric motor 66. The controller 82 is further configured to send a control signal to the control valves 80 to cause one or both of the solenoid coils in the control valves 80 to open and thus provide a supply of gas. The controller 82 is further configured to cause the electrode 56 to spark and thus create the burner flame, and then monitor the flame current from the burner skin 52 and electrode 56, thus enabling calculation of the above-described flame ionization current, in real time. Based on the flame ionization current, the controller 82 is configured to further control the speed of the fan 64 (via for example the motor 66). Each of the above functions are carried out via the illustrated wired or wireless links, which together can be considered to be a computer network to which the various devices are connected. Operation of the gas burner 44 warms the heat exchanger 40 including the body 42 and fins 43. Operation of the fan 28 causes air to be conveyed through the housing 18 and across the fins 43. The relatively warm fins 43 exchange heat with the relatively cool air, thus warming the air prior to discharge via the warm air outlet 26.

Referring now to FIGS. 3-9, the construction of the fan 64 will be more fully described. As shown in FIGS. 3-6, an air-gas mixture inlet 88 is formed through the end cap 72 and conveys the initial mixture of air and gas from the upstream gallery 55 to the interior 69 (see FIG. 1) of the fan 64. An air-gas mixture outlet 90 is formed through the end cap 72 and conveys the more fully mixed air-gas mixture from the interior 69 of the fan 64 to a downstream gallery 92 (see FIG. 1) located downstream of the fan 64 and upstream of the gas burner 44. The end cap 72 has a radial center 94 located at the axis of rotation 35 and a radial outer end 96 that circumscribes the radial center 94. The air-gas mixture inlet 88 and the air-gas mixture outlet 90 are formed through the end wall 73, at respective locations that are radially between the radial center 94 and the radial outer end 96. In the illustrated example, the air-gas mixture inlet 88 comprises a window 89 that faces radially inwardly towards the axis of rotation 35 (i.e., downwardly in the view shown in FIG. 6). The air-gas mixture outlet 90 comprises a window that faces axially through the end wall 73 (i.e., towards the page in view shown in FIG. 6).

Figure 6:
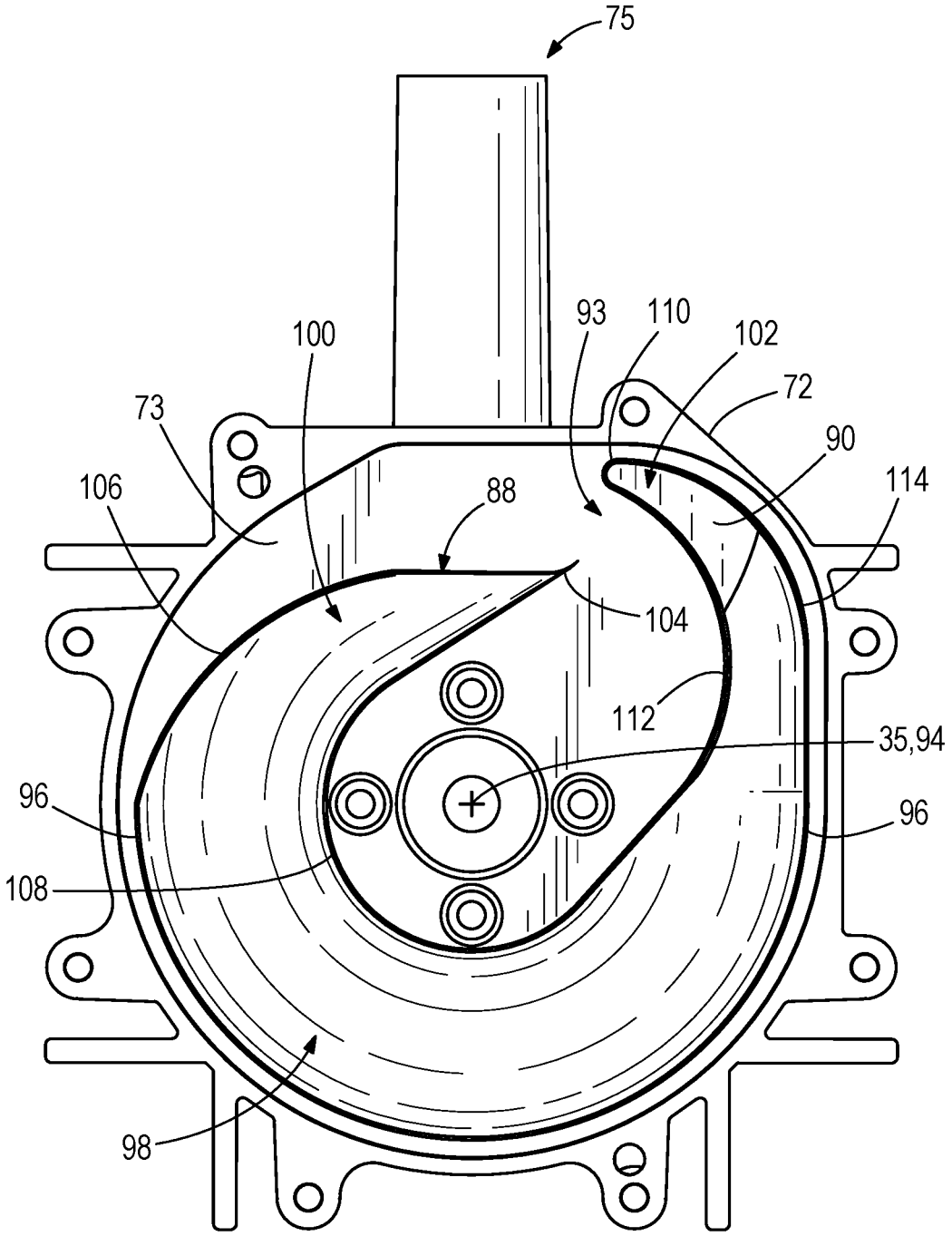
FIG. 6 is a front view of the inside of the end cap.
Figure 8:
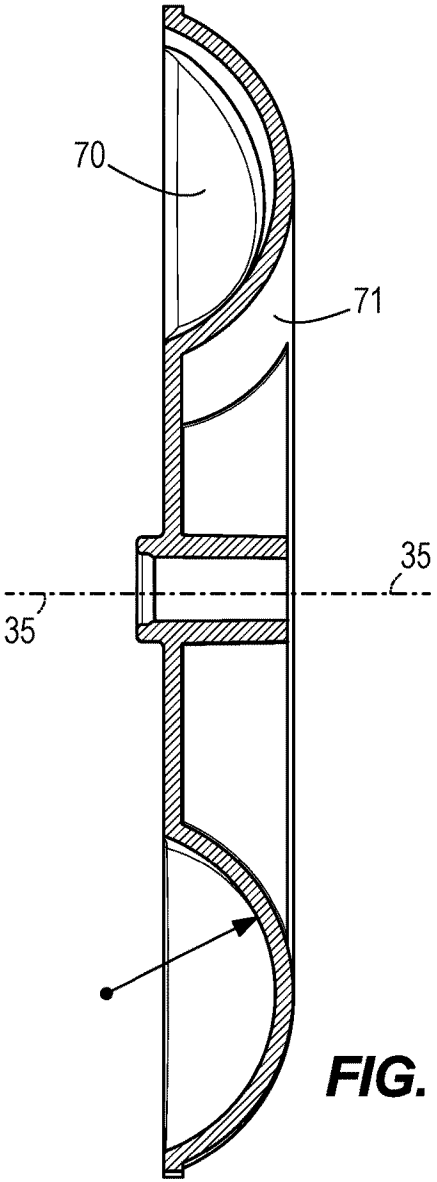
FIG. 8 is a view of section 8-8, taken in FIG. 7.
Figure 7:
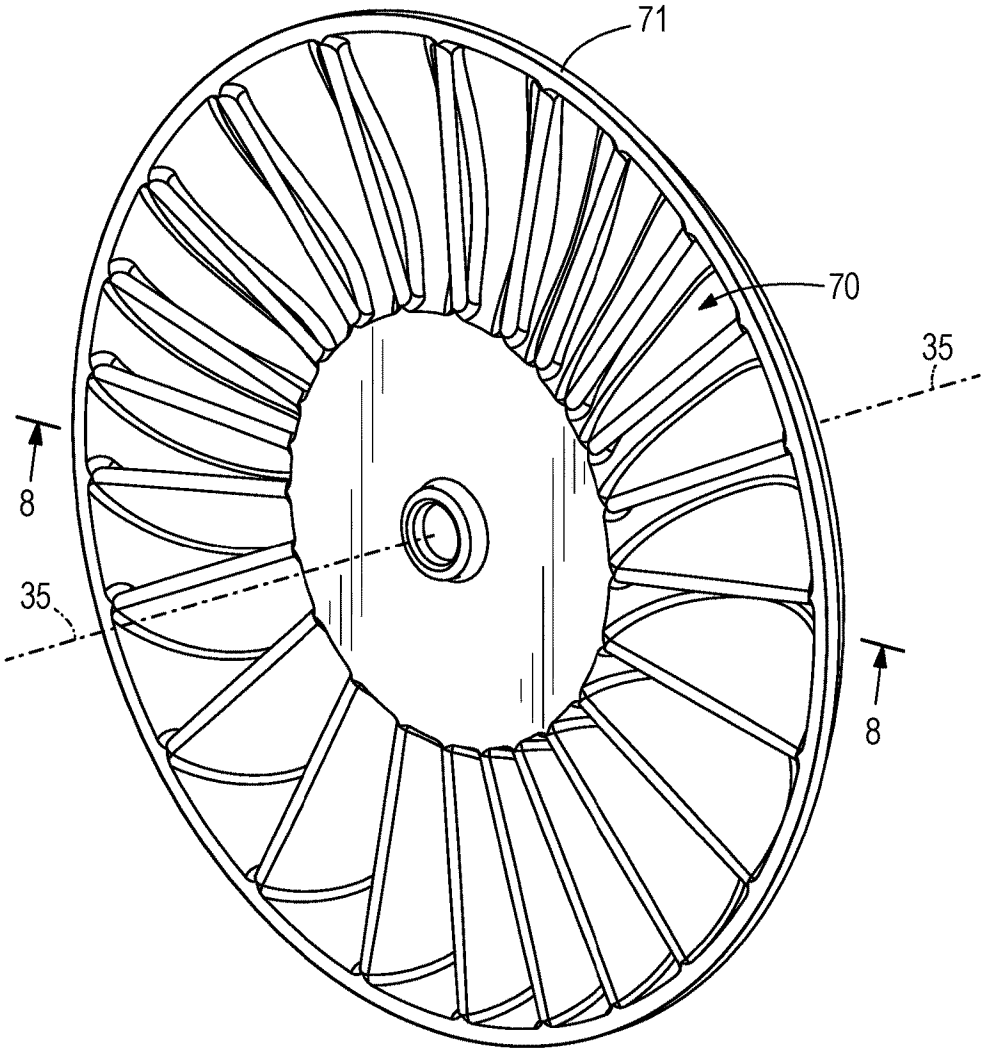
FIG. 7 is a perspective view of the fan.
Figure 9:
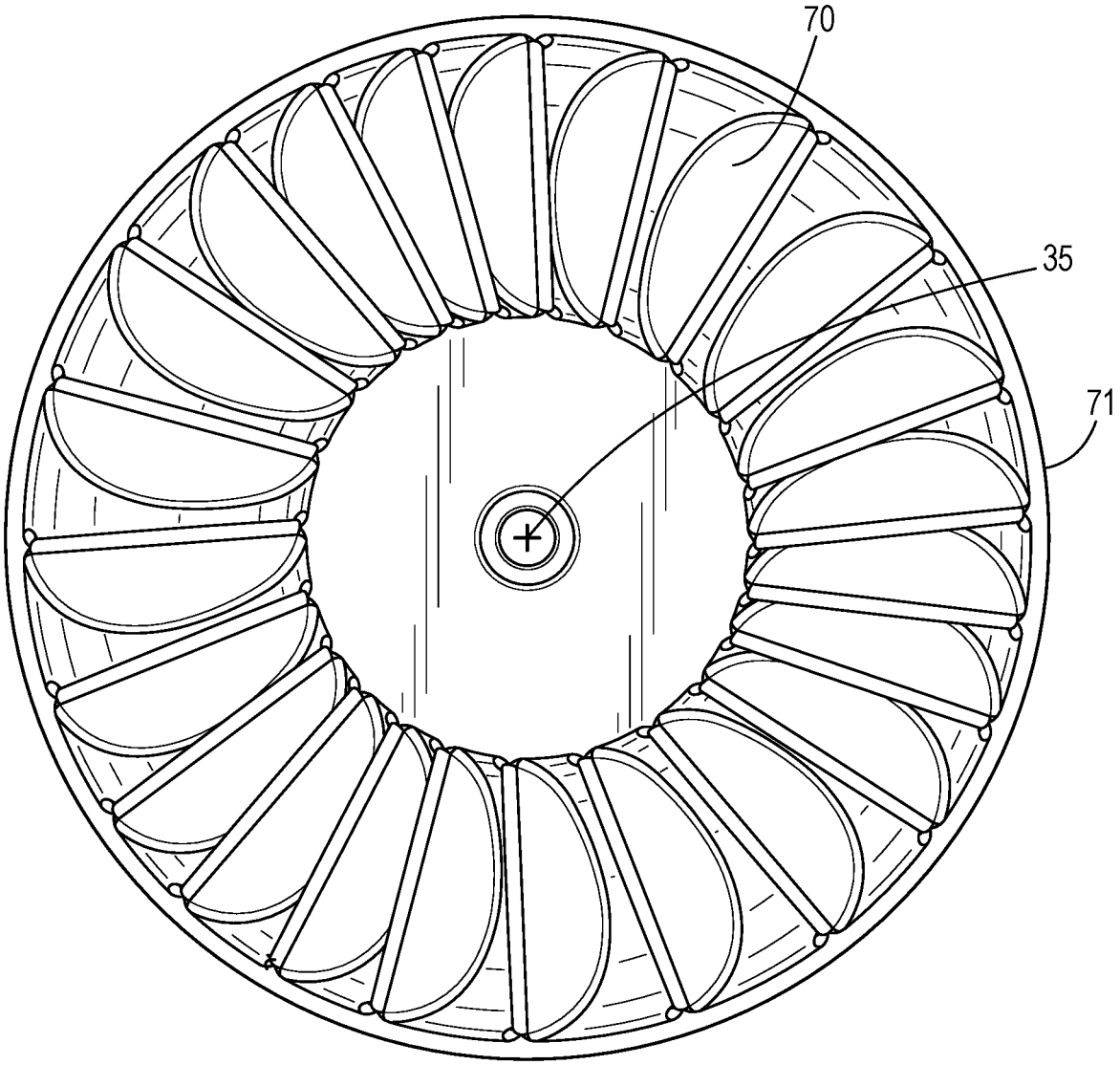
FIG. 9 is a front view of the fan.

A channel 98 is formed in the end wall 73 and connects the air-gas mixture inlet 88 to the air-gas mixture outlet 90. The air-gas mixture flows through the channel 98 from the air-gas mixture inlet 88 to the air-gas mixture outlet 90 in generally the same direction as the direction of rotation of the blades 70 (counter-clockwise in FIG. 6). The channel 98 forms a depression in the end cap 72 that gradually becomes shallower with respect to the end wall 73 along its length from the air-gas mixture inlet 88 to the air-gas mixture outlet 90, thus gradually forcing the air-gas mixture axially into the interior 69 and into the compartments formed between the adjacent blades 70. As seen in FIG. 6, the channel 98 curves more than halfway around the axis of rotation 35 from the air-gas mixture inlet 88 to the air-gas mixture outlet 90. However the channel 98 does not radially overlap at the air-gas mixture inlet 88 and the air-gas mixture outlet 90. Rather, there is separation between the air-gas mixture inlet 88 and air-gas mixture outlet 90, as shown at arrow 93. In other examples, the channel 98 curves less than halfway around the axis of rotation 35.

The channel 98 has an inlet end 100 at the air-gas mixture inlet 88 and an outlet end 102 at the air-gas mixture outlet 90. The inlet end 100 generally has a crescent shape with a narrow tip 104 located at the air-gas mixture inlet 88, more specifically at the radially inner end 105 of the noted window. The inlet end 100 gradually widens as it extends along the channel 98 away from the narrow tip 104. In particular, the inlet end 100 has a radially outer edge 106 and a radially inner edge 108. The radially outer edge 106 extends in a straight line along the window 89 and then radially outwardly curves towards the radially outer end 96 of the end cap 72. The radially inner edge 108 forms a generally straight tangent from the noted window 89 and then tightly curves around the radial center 94 of the end cap 72. The outlet end 102 has a crescent shape with a narrow tip 110 located at the air-gas mixture outlet 90. The outlet end 102 gradually narrows towards the narrow tip 110. In particular, the outlet end 102 has a radially inner edge 112 and a radially outer edge 114. In the counter-clockwise direction, the radially inner edge 112 extends generally radially outwardly and then curves more severely towards the narrow tip 104. The radial outer edge 114 curves generally alongside the radial outer end 96 of the end cap 72.

Figure 11:
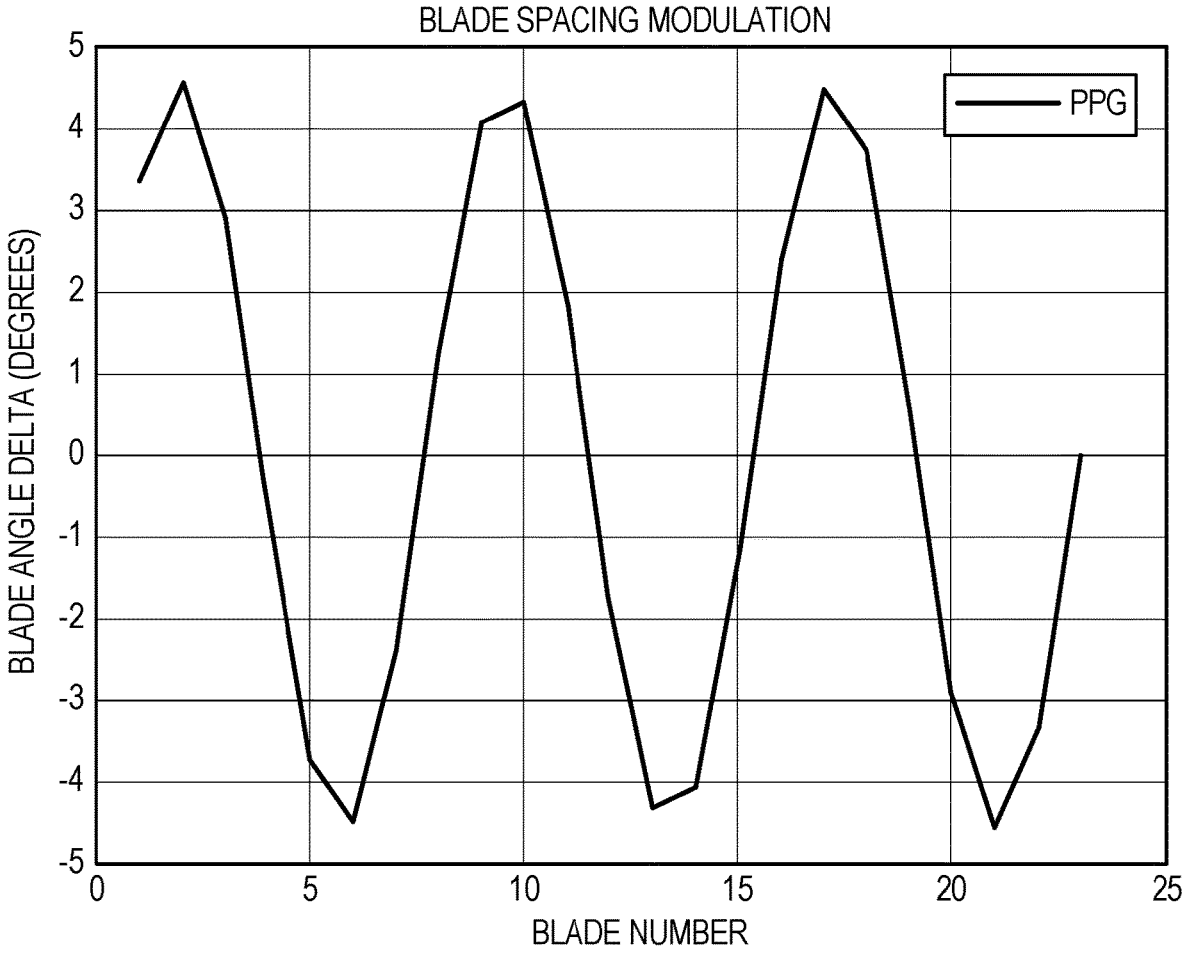
FIG. 11 is a graph illustrating blade spacing modulation.

Referring to FIGS. 7-11, the plurality of blades 70 includes twenty-three blades that rotate about the axis of rotation 35. To limit the noise emanating from the fan 64, the blades 70 have a sinusoidal blade spacing (i.e. the spacing between the respective blades in the plurality follows a sinusoidal wave pattern) around the circumference of the axis of rotation 35. FIGS. 10 and 11 display exemplary sinusoidal blade spacing for the blades 70. As shown in FIG. 10, the blades 70 also have a maximum blade modulation angle of 4.6 degrees and a forward angle so that they propel the air-gas mixture towards the air-gas mixture outlet 90 in the end cap 72. The sinusoidal-modulated blade spacing has three modulation periods per revolution of the blades 70, about the axis of rotation 35, as shown in FIGS. 10 and 11. There does not have to be three modulation periods per revolution. In other examples, there are two or more than three.

Advantageously, the air and gas are introduced into the interior 69 close to the radial center 94, which facilitates mixing. The relatively large number of blades (twenty-three) provides a large number of chambers for mixing. In particular, the larger number of relatively small chambers allows for greater mixing than would a relatively fewer number of larger chambers. A larger number of blades would create a higher blade pass frequency. However, as explained above, the sinusoidal blade spacing advantageously minimizes acoustic noise by spreading the acoustic pressure pulses across the frequency spectrum, resulting in reduced tone prominence at any given blade pass frequency. The end cap 72 includes the specially configured channel 98, which gradually increases the volume in any individual chamber within the fan. This reduces the amplitude of the pressure pulse generated by a blade pass. In the example shown, the chambers are never open to the outlet and the inlet side of the device at the same time because the inlet 88 and outlet 90 are not radially overlapping. Thus, the design optimizes noise, vibration and harmonics requirements from the user while delivering the required performance.

Although specific advantages have been enumerated above, various embodiments may include some, none, or all of the enumerated advantages. Other technical advantages may become readily apparent to one of ordinary skill in the art after review of the following figures and description. Modifications, additions, or omissions may be made to the systems, apparatuses, and methods described herein without departing from the scope of the disclosure. For example, the components of the systems and apparatuses may be integrated or separated. Moreover, the operations of the systems and apparatuses disclosed herein may be performed by more, fewer, or other components and the methods described may include more, fewer, or other steps. Additionally, steps may be performed in any suitable order. As used in this document, "each" refers to each member of a set or each member of a subset of a set.

To aid the Patent Office and any readers of any patent issued on this application in interpreting the claims appended hereto, applicants wish to note that they do not intend any of the appended claims or claim elements to invoke 35 U.S.C. 112(f) unless the words "means for" or "step for" are explicitly used in the particular claim.

What is claimed is:

1. A forced-draft pre-mix burner device comprising: a housing that conveys air from an upstream cool air inlet to a downstream warm air outlet; a heat exchanger that warms the air prior to discharge via the warm air outlet; a gas burner that burns an air-gas mixture to thereby warm the heat exchanger; and a fan that mixes the air-gas mixture and forces the air-gas mixture into the gas burner, wherein the fan comprises a plurality of blades having sinusoidal-modulated blade spacing; wherein the fan further comprises an end cap having an end wall that faces the plurality of blades, an air-gas mixture inlet through which the air-gas mixture is conveyed to the plurality of blades, and an air-gas mixture outlet through which the air-gas mixture is conveyed to the gas burner; wherein the plurality of blades rotates about an axis of rotation extending in an axial direction, wherein the plurality of blades extends radially relative to the axial direction, wherein the end cap has a radial center located at the axis of rotation and a radial outer end that circumscribes the axis of rotation, and wherein air-gas mixture inlet and air-gas mixture outlet are formed through the end wall, radially between the radial center and the radial outer end; and wherein the air-gas mixture inlet is connected to the air-gas mixture outlet via a channel formed in the end wall and facing the plurality of blades in the axial direction, wherein the channel has a length extending from the air-gas mixture inlet to the air-gas mixture outlet, and wherein the channel gradually becomes shallower along an entirety of the length from the air-gas mixture inlet to the air-gas mixture outlet, so as to gradually introduce the air-gas mixture into the plurality of blades in the axial direction.

2. The forced-draft pre-mix burner device according to claim 1, wherein the plurality of blades comprises twenty-three blades that rotate about an axis of rotation.

3. The forced-draft pre-mix burner device according to claim 2, wherein the sinusoidal-modulated blade spacing has three modulation periods per fan revolution.

4. The forced-draft pre-mix burner device according to claim 3, wherein the plurality of blades comprises a maximum blade modulation angle of 4.6 degrees.

5. The forced-draft pre-mix burner device according to claim 1, wherein the plurality of blades has a forward angle so that the plurality of blades propels the air-gas mixture towards the gas burner.

6. The forced-draft pre-mix burner device according to claim 1, wherein the channel curves at least halfway around the axis of rotation from the air-gas mixture inlet to the air-gas mixture outlet.

7. The forced-draft pre-mix burner device according to claim 6, wherein the channel has a crescent shape with a narrow tip located at the air-gas mixture inlet.

8. The forced-draft pre-mix burner device according to claim 7, wherein the channel has an inlet end that gradually widens along the channel from the narrow tip.

9. The forced-draft pre-mix burner device according to claim 6, wherein the channel has a crescent shape with a narrow tip located at the air-gas mixture outlet.

10. The forced-draft pre-mix burner device according to claim 9, wherein the channel has an outlet end that gradually narrows towards the narrow tip.

11. The forced-draft pre-mix burner device according to claim 1, wherein the air-gas mixture inlet comprises a window formed through the end wall, the window facing radially inwardly towards the axis of rotation.

12. The forced-draft pre-mix burner device according to claim 1, wherein the channel extends around the radial center but does not radially overlap at the air-gas mixture inlet and air-gas mixture outlet.

13. A forced-draft pre-mix burner device comprising:

a housing that conveys air from an upstream cool air inlet to a downstream warm air outlet;

a heat exchanger that warms the air prior to discharge via the warm air outlet;

a gas burner that burns an air-gas mixture to thereby warm the heat exchanger; and a fan that mixes the air-gas mixture and forces the air-gas mixture into the gas burner, wherein the fan comprises a plurality of blades having sinusoidal-modulated blade spacing and configured to rotate about an axis of rotation, wherein the plurality of blades radially extends relative to the axis of rotation, an end cap having an end wall that faces the plurality of blades, an air-gas mixture inlet formed through the end wall radially between the radial center and the radial outer end and through which the air-gas mixture is conveyed to the plurality of blades, an air-gas mixture outlet formed through the end wall radially between the radial center and the radial outer end and through which the air-gas mixture is conveyed to the gas burner, and a channel formed in the end wall and axially facing the plurality of blades, the channel having a length extending around the radial center from the air-gas mixture inlet to the air-gas mixture outlet, wherein the channel gradually becomes shallower along an entirety of the length from the air-gas mixture inlet to the air-gas mixture outlet, so as to gradually introduce the air-gas mixture axially into the plurality of blades.

14. The forced-draft pre-mix burner device according to claim 13, wherein the channel has a crescent shape with a narrow tip located at the air-gas mixture inlet.

15. The forced-draft pre-mix burner device according to claim 14, wherein the channel has an inlet end that gradually widens along the channel from the narrow tip.

16. The forced-draft pre-mix burner device according to claim 13, wherein the channel has a crescent shape with a narrow tip located at the air-gas mixture outlet.

17. The forced-draft pre-mix burner device according to claim 16, wherein the channel has an outlet end that gradually narrows towards the narrow tip.

18. The forced-draft pre-mix burner device according to claim 13, wherein the air-gas mixture inlet comprises a window formed through the end wall, the window facing radially inwardly towards the axis of rotation.

19. The forced-draft pre-mix burner device according to claim 13, wherein the channel extends around the radial center but does not radially overlap at the air-gas mixture inlet and air-gas mixture outlet.

20. A forced-draft pre-mix burner device comprising:

a housing that conveys air from an upstream cool air inlet to a downstream warm air outlet;

a heat exchanger that warms the air prior to discharge via the warm air outlet;

a gas burner that burns an air-gas mixture to thereby warm the heat exchanger; and a fan that mixes the air-gas mixture and forces the air-gas mixture into the gas burner, wherein the fan comprises a plurality of blades having sinusoidal-modulated blade spacing, wherein the plurality of blades rotates about an axis of rotation extending in an axial direction, and further wherein the plurality of blades extends radially relative to the axial direction, an end cap having an end wall that faces the plurality of blades, and an air-gas mixture inlet through which the air-gas mixture is conveyed to the plurality of blades and an air-gas mixture outlet through which the air-gas mixture is conveyed to the gas burner, wherein the air-gas mixture inlet is connected to the air-gas mixture outlet via a channel formed in the end wall, the channel facing the plurality of blades in the axial direction, and further wherein between the air-gas mixture inlet and the air-gas mixture outlet the channel gradually becomes shallower so as to gradually introduce the air-gas mixture into the plurality of blades in the axial direction as the air-gas mixture is conveyed along the channel.

* * * * *